343-756 SR
3/24/87 OR 4,652,886

United States Patent [19]
Rosser et al.

[11] Patent Number: 4,652,886
[45] Date of Patent: Mar. 24, 1987

[54] MULTILAYER ANTENNA APERTURE POLARIZER

[75] Inventors: William D. Rosser, Los Altos; Howard Hochman, San Jose, both of Calif.

[73] Assignee: GTE Government Systems Corporation, Stamford, Conn.

[21] Appl. No.: 840,185

[22] Filed: Mar. 17, 1986

[51] Int. Cl.[4] ..... H01Q 15/24
[52] U.S. Cl. ..... 343/756; 343/909
[58] Field of Search ..... 343/756, 783, 786, 909, 343/915

[56] References Cited

U.S. PATENT DOCUMENTS 3,754,271 8/1973 Epis ..... 343/756
4,387,377 6/1983 Kandler ..... 343/756

*Primary Examiner*—Eli Lieberman
*Assistant Examiner*—D. Johnson
*Attorney, Agent, or Firm*—Douglas M. Gilbert; John F. Lawler

[57] ABSTRACT

A multilayer antenna aperture polarizer comprises a single continuous electrically conductive trace on a flexible thin dielectric strip, the trace being formed into a plurality of arrays of grid lines with adjacent arrays interconnected by shorting leads and with a ground lead connected to the last or end array. The strip and shorting leads are folded at the locations of the shorting leads to form a stack of plane parallel polarizer panels, each comprising an array on the strip, adjacent panels in the stack being spaced apart in a direction transversely of the planes of the panels by insulator spacers, respectively. The polarizer is inserted in front of the aperture of the antenna and the ground lead is electrically connected to the antenna frame for grounding the several arrays. The shorting and ground leads are located at the corners of the stack in the neutral or minimum field zone of the antenna. All of the arrays are thus interconnected electrically and are grounded without the presence of field-disturbing soldered joints or the like.

7 Claims, 12 Drawing Figures

MULTILAYER ANTENNA APERTURE POLARIZER

This invention was made under a contract with the Department of Defense.

BACKGROUND OF THE INVENTION

This invention relates to antennas and more particularly to an improved antenna aperture polarizer.

One type of polarizer to which this invention relates constitutes a cover placed in front of the aperture of an antenna such as a pyramidal horn for converting linearly polarized waves propagating in the horn to circularly polarized waves on the other side of the polarizer. Such a polarizer consists of a plurality of spaced arrays of conductive traces extending across the horn aperture generally at an acute angle to the plane of polarization of the horn. A polarizer of this type is described in U.S. Pat. No. 3,754,271.

A difficulty encountered with prior antenna polarizers is the buildup of a static electrical charge on the ungrounded arrays which tends to cause arcing between the array and metallic parts of the antenna. Such arcing is undesirable because it adversely affects the antenna radiation pattern. Attempts to solve this problem have involved grounding the arrays with shorting wires soldered to the respective arrays and to ground. This construction has been unsatisfactory, however, because of unreliability of the resulting joints, the difficulty in making them, and the electric field perturbation they tend to cause.

This invention is directed to a solution to this problem.

OBJECTS AND SUMMARY OF THE INVENTION

A general object of the invention is the provision of a multilayer antenna polarizer with a simplified structurally reliable grounding mechanism.

A further object is the provision of such a polarizer that does not adversely affect the radiating field of the antenna.

These and other objects of the invention are achieved with a polarizer having a plurality of conductive arrays interconnected by shorting leads and having a ground lead connected to the last or end array; the arrays, shorting leads and ground lead are a single continuous conductor formed on a thin flexible dielectric strip as a printed circuit.

BRIEF DESCRIPTION OF THE DRAWINGS

For a better understanding of the invention as well as other objects and further features thereof, reference is made to the following description which is to be read in conjunction with the accompanying drawings wherein.

DESCRIPTION OF PREFERRED EMBODIMENTS

Figure 1:
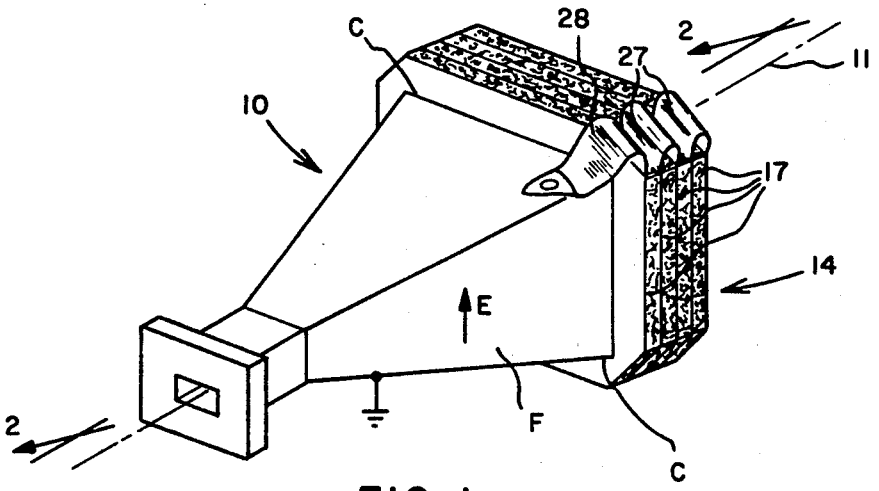
FIG. 1 is a perspective view of a horn antenna with a polarizer embodying the invention mounted in the aperture.
Figure 2:
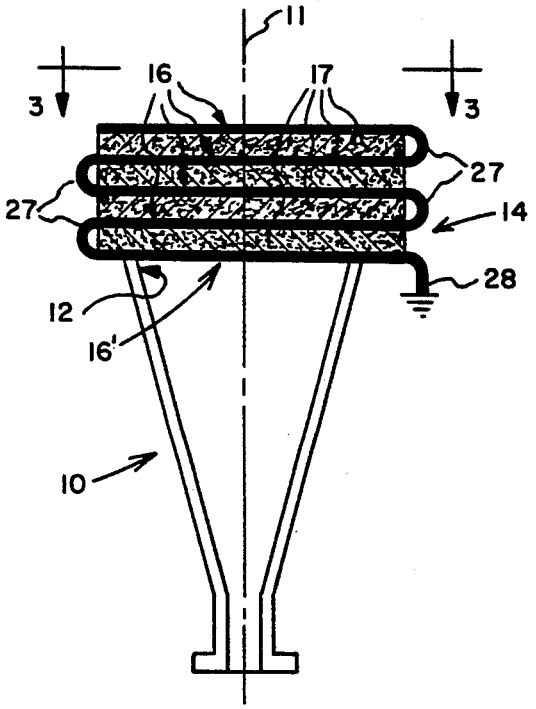
FIG. 2 is a section taken on line 2—2 of FIG. 1.

Referring now to the drawings, FIGS. 1 and 2 show a pyramidal horn antenna 10 with a longitudinal axis 11 and a rectangularly-shaped aperture 12, and having a polarizer 14 embodying the invention mounted in aperture 12 and secured therein by an epoxy or the like. Antenna 10 is linearly polarized in the direction of the electric vector E, see FIGS. 1 and 3. The purpose of polarizer 14 is to change the polarization of the electromagnetic wave passing through it from the horn, for example, from linear to circular polarization. Corners C of aperture 12 are essentially nonradiating or neutral zones of the antenna, the significance of which is explained below.

Figure 4:
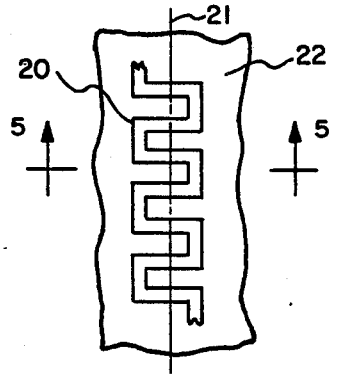
FIG. 4 is a greatly enlarged view of a portion of FIG. 3 showing the structure of one of the array grid lines.
Figure 5:
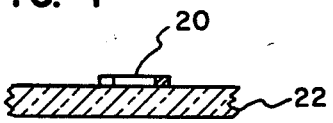
FIG. 5 is a section taken on line 5—5 of FIG. 4.
Figure 7:
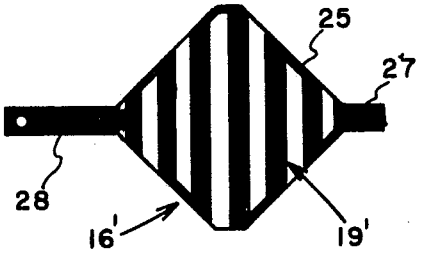
FIG. 7 is a plan view of a polarizer panel embodying the invention and showing an alternate form of grid line array.

Polarizer 14 comprises a plurality of plane panels 16 stacked along horn axis 11 with the planes of panels 16 parallel and extending transversely of and preferably perpendicular to antenna axis 11. Panels 16 are supported on and axially spaced apart by low-loss dielectric spacers 17, respectively, such as polyfoam or thin-walled dielectric honeycomb material. Each panel comprises an array 19 of laterally spaced electrically conductive grid lines 20, see FIGS. 3–5, inclusive, having axes 21, and a thin flexible low-loss dielectric strip 22 which supports grid lines 20. One configuration of grid line 20 that may be used is the meanderline, see FIGS. 4 and 5, which is described in the aforementioned U.S. Pat. No. 3,754,271 and which is used to convert linearly polarized waves from horn 10 to circularly polarized waves. Each grid line 20 is connected at opposite ends to adjacent grid lines by continuous peripheral conductors 24, see FIG. 3, or alternatively, by discontinuous peripheral conductors 25, see FIG. 7. Arrays 19 including grid lines 20 and peripheral conductors 24 or 25 constitute a thin conductive trace of copper or the like. The trace may be formed by plating on one continuous dielectric strip 22 composed of a thin flexible material such as polymeric film and by printed circuit techniques such as by photoetching the plating.

The foregoing description of polarizer 14 relates to a prior art construction and does not per se constitute this invention.

In accordance with this invention, arrays 19 of adjacent panels 16 are interconnected by shorting leads 27 which are integral with the arrays. A ground lead 28 extends from and is likewise integral with array 19' of the last or end panel 16' proximate to metallic frame F of horn antenna 10. Lead 28 is adapted to be fastened to antenna F for grounding purposes. Shorting leads 27 and ground lead 28 are formed on narrow sections **22*a* and 22*b*, (see FIG. 6) respectively, of dielectric strip 22 at the same time as are arrays 19 on the larger sections 22*c* of strip 22 by the aforementioned printed circuit technique. The plurality of arrays 19 of the polarizer and the shorting and grounding leads 27 and 28 constitute a single and continuous flexible seamless and jointless electrical conductor. Dielectric strip 22** includes sections *22a, 22b* and *22c* and is one continuous piece.

Figure 3:
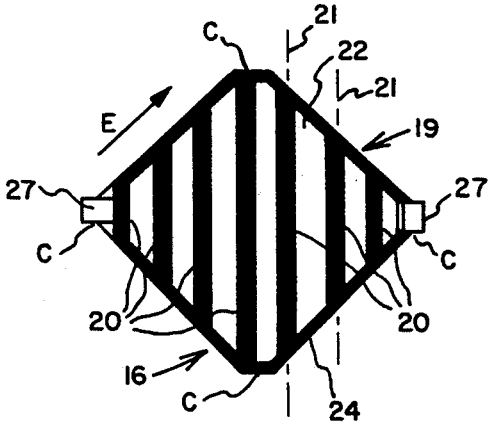
FIG. 3 is a plan view taken on line 3—3 of FIG. 2.

Grid lines 20 are oriented at an acute angle relative to polarization vector E of antenna 10 as shown in FIG. 3 in order to achieve the desired change in polarization characteristics of the signal passing through polarizer 14. In the embodiments shown in FIGS. 6 and 7, ground lead 28 and shorting leads 27 are connected to the corners of arrays 19' and 19, respectively, and, when assembled in a stack and fitted into the aperture of horn antenna 10 as shown in FIGS. 1, 2 and 3, are located in the neutral or non-radiating zones of the antenna. This arrangement insures that these leads have minimal adverse effect on the radiation pattern of the antenna while providing a good ground path for the several polarizer arrays.

Figure 8:
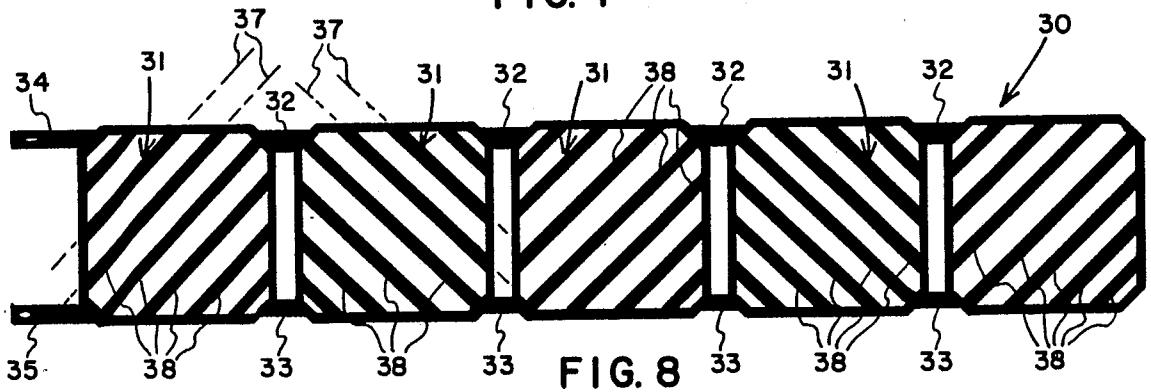
FIG. 8 is a view similar to FIG. 6 showing a modified form of the invention with dual shorting and ground leads.
Figure 10:
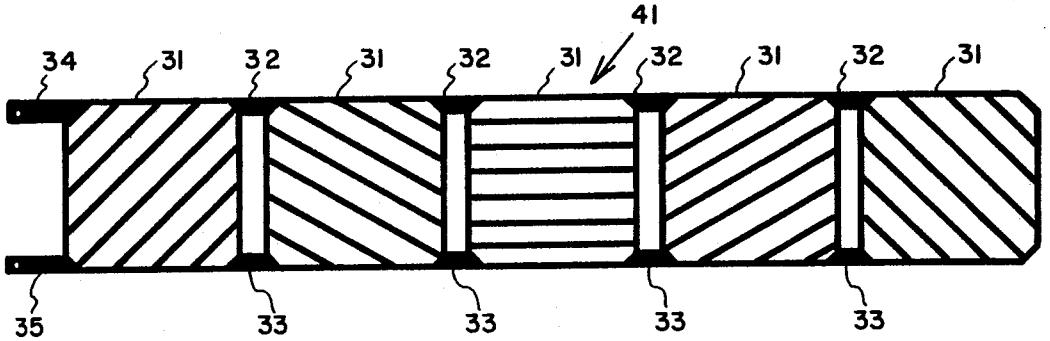

A modified form of the invention shown in FIG. 8 illustrates a polarizer 30 having a plurality of arrays 31 with adjacent arrays electrically interconnected by two shorting leads 32 and 33 and with the end or last array 31' connected to two ground leads 34 and 35. The axes 37 of grid lines 38 on adjacent arrays 31 are oriented with respect to each other to give the proper polarization after assembly and are rotated 45 degrees from those in FIG. 6 because of the manner in which the adjacent arrays are connected. In other respects the embodiment of FIG. 10 is the same as polarizer 14 described above both in structure and method of fabrication. The advantage of dual shorting of ground leads is more efficient grounding of the arrays. When arrays 31 are stacked as described above to form polarizer 30, axes 37 of grid lines 38 are parallel and are aligned with each other in the direction of antenna axis 11.

Figure 6:
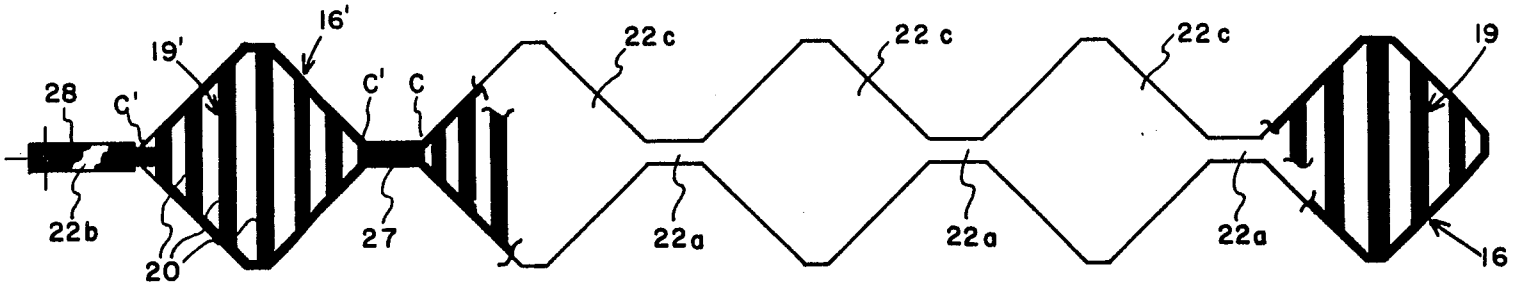
FIG. 6 is a plan view of the polarizer of FIG. 1 with the several panels thereof in an unstacked state.
Figure 9:
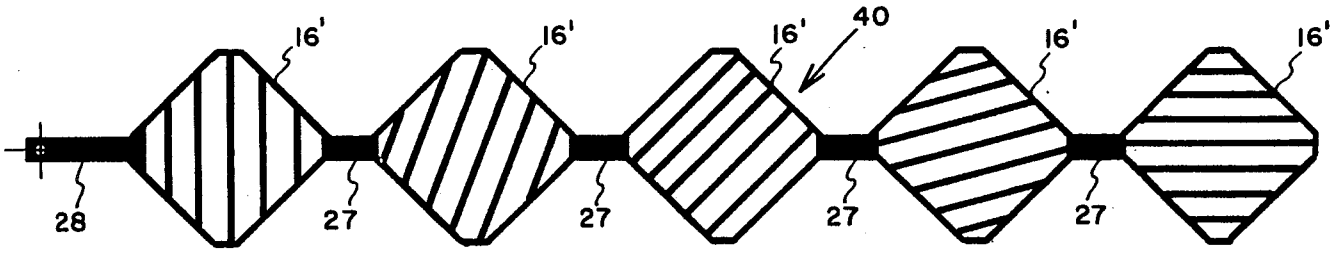
FIGS. 9 and 10 are views similar to FIGS. 6 and 8, respectively, showing another form of the invention.
Figure 11:
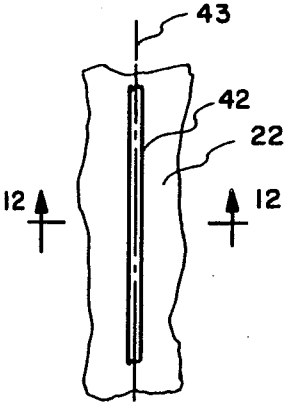
FIG. 11 is a greatly enlarged view of a portion of FIG. 9 showing the structure of one of the array grid lines.
Figure 12:
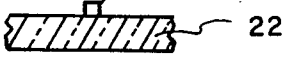
FIG. 12 is a section taken on line 12—12 of FIG. 11.

FIGS. 6 and 8 show arrays 19 and 31, respectively, with the axes of their respective grid lines 20 and 38 oriented as are the corresponding grid lines for the polarizer described in U.S. Pat. No. 3,754,271 for circular polarization. FIGS. 9 and 10 show single and double grounded arrays, 40 and 41, respectively, constructed to provide a linearly polarized wave having a changed angle of polarization. Arrays 40 and 41 are formed with straight grid lines 42, see FIGS. 11 and 12, each grid line 42 having an axis 43. As shown in the drawings, the angle of grid line axis 43 is incrementally and progressively changed in the same sense or direction from array to adjacent array. The polarization angle of the propagating electromagnetic waves is changed, for example, from vertical to horizontal, and this is accomplished by the relative and progressive change in the angle of grid lines 42 of successive arrays. In other respects, arrays 40 and 41 are constructed as described above, like reference characters indicating like parts in the drawings.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. A multilayer polarizer comprising:

an elongated flexible dielectric strip;

a plurality of longitudinally spaced electrically conductive plane polarizer arrays on said strip;

an electrically conductive shorting lead on said strip and interconnecting each adjacent pair of said polarizer arrays;

an electrically conductive ground lead on said strip electrically connected to the array at one end of said plurality of arrays;

said arrays, said shorting leads and said ground lead being a continuous electrical conductor;

each array and the portion of said strip attached thereto constituting a panel;

said strip and said shorting leads being folded at the location of said shorting leads, respectively, and defining a stack of plane parallel polarizer panels spaced apart in a direction transversely of the planes of said panels; and insulator means between said spaced polarizer panels.

2. The polarizer according to claim 1 in which each of said arrays comprises a plurality of laterally spaced grid lines having parallel axes.

3. The polarizer according to claim 2 in which said arrays, said shorting leads and said ground lead comprise a printed circuit.

4. The polarizer according to claim 1 in combination with an antenna aperture, said polarizer being disposed in said aperture with said shorting leads being aligned at 45 degrees to the E-field of the waves emanating from said aperture and said ground lead being aligned at the same angle.

5. In a multilayer polarizer adapted to change the polarization of electromagnetic waves propagating therethrough and having a stack of substantially identical parallel plane panels spaced apart in a direction transversely of the planes of said panels, each panel having an array consisting of a plurality of laterally spaced electrically interconnected conductors with parallel axes, electrically conductive shorting leads electrically connecting the arrays, respectively, of adjacent panels, and a ground lead electrically connected to the array on the panel at one end of said stack, the improvement of:

said arrays and said shorting leads and said ground lead being a single continuous electrical conductor.

6. The polarizer according to claim 4 in which said arrays and said shorting leads and said ground lead constitute a printed circuit.

7. The polarizer according to claim 5 in which said panels and said shorting leads and said ground lead also comprise a thin flexible dielectric film, said single electrical conductor being formed on said film.

* * * * *